US005434654A

United States Patent [19]

Nagai

[11] Patent Number: 5,434,654

[45] Date of Patent: Jul. 18, 1995

[54] TONER CARTRIDGE WITH AIR PERMEABLE MEMBER

[75] Inventor: Takanori Nagai, Kanagawa, Japan

[73] Assignee: Fuji Xerox Co., Ltd., Tokyo, Japan

[21] Appl. No.: 242,812

[22] Filed: May 16, 1994

[30] Foreign Application Priority Data

May 17, 1993 [JP] Japan ..... 5-136926

[51] Int. Cl.[6] ..... G03G 15/06

[52] U.S. Cl. ..... 355/260; 222/DIG. 1; 355/215

[58] Field of Search ..... 355/215, 245, 260; 222/DIG. 1

[56] References Cited

U.S. PATENT DOCUMENTS

| | | | |
|---|---|---|---|
| 4,583,112 | 4/1986 | Morano et al. | 355/215 |
| 4,816,877 | 3/1989 | Keen | 222/DIG. 1 |
| 5,101,871 | 4/1992 | Susumu | 355/260 X |
| 5,221,945 | 6/1993 | Smith | 355/260 |

FOREIGN PATENT DOCUMENTS

| | | | |
|---|---|---|---|
| 4128101 | 2/1993 | Germany | 355/260 |
| 60-263972 | 12/1985 | Japan | 355/260 |
| 3-71362 | 11/1989 | Japan . | |
| 4-359274 | 6/1991 | Japan . | |
| 4-9982 | 1/1992 | Japan | 355/260 |

*Primary Examiner*—William J. Royer
*Attorney, Agent, or Firm*—Finnegan, Henderson, Farabow, Garrett & Dunner

[57] ABSTRACT

A toner cartridge of the present invention includes a container for containing toner, a toner discharge port, a sealing member for sealing the toner discharge port, an air communicating hole having an area smaller than that of the discharge port, and an air permeable member made of porous material for covering the air hole, adjusting a pressure within the container, and restricting permeation of moisture into the container so as to prevent a blocking phenomenon of toner. Specifically, a coefficient of moisture permeability of the porous material is 100 to 1000 g/m$^2$/24 hours in a measuring method of JIS (Japanese Industrial Standard) L-1096-A-11 to restrict permeation of moisture into the container so as to prevent a blocking phenomenon of toner. Accordingly, the toner cartridge of the present invention scatters little toner, is insensitive to variation of ambient conditions, and deteriorates the quality of toner very little even after a long time storage.

14 Claims, 2 Drawing Sheets

TONER CARTRIDGE WITH AIR PERMEABLE MEMBER

BACKGROUND OF THE INVENTION

1. Field of the Invention

The present invention relates to a toner cartridge for supplying toner in electronic copying machines, printers, and the like.

2. Description of the Related Art

Conventionally, a perfectly sealed container is used for a toner cartridge, in order to completely shut out moisture. This type of toner cartridge can prevent toner from cohering together within the cartridge by completely shutting out moisture. Since the container is hermetically sealed, there is a danger that it will burst when temperature and pressure vary during transportation or the like.

In the case of the toner cartridge of the open type, it is impossible to perfectly protect the contained toner from moisture. Accordingly, this type of toner cartridge suffers from toner cohesion and deterioration of toner quality.

In order to remove the above defects, Unexamined Japanese Utility Model Publication No. Hei. 3-71362 discloses a toner cartridge 101 as shown in FIGS. 1(*a*) and 1(*b*). A cylindrical cartridge body 102 is provided with the toner cartridge 101, in which one end opening portion 102*a* is sealed. A toner discharge portion 103 having a toner discharge hole 104 is provided on the side surface of the cartridge body 102. The toner discharge hole is sealed by a sealing member 105. A rolling portion 106 for rolling the sealing member 105 is provided with the cartridge body 102. A cover 107 having an air hole 108 is mounted on the other end opening portion 102*b* of the cartridge body 102. An air filter 109 for covering the air hole 108 is mounted on the cover 107. On the outside of the cover 107, a deflated bag member 110 is provided. The cover portion as shown in FIG. 1(*b*) is inserted into the opening portion 102*b* from the direction of an arrow indicated in the right side of FIG. 1(*a*). When an inner pressure of the cartridge body 102 is increased, air flows into the bag member 110 to adjust the inner pressure, whereby moisture is shut out.

In addition, Unexamined Japanese Patent Publication No. Hei. 4-359274, discloses another toner cartridge, shaped like a box, in which a sheet member at the temperature of 4° C. to 300° C. in the coefficient of air permeability is coated with adhesive, and a toner discharge port of the main body of the container is heat sealed with the sheet member.

In the case of the former toner cartridge disclosed in Unexamined Japanese Utility Model Publication No. Hei. 3-71362, it is provided with the bag member, and hence is of the closed type. Accordingly, it is capable of shutting out moisture. However, when the inner pressure is high, the bag member is inflated so as to occupy an excessive space in an apparatus such as a printer, copy machine or the like. In addition, many parts are used to mount the bag member, thereby impairing the manufacturing efficiency. Further, since the inner pressure is high, the bag member remains inflated. This inflated state makes it difficult to mount the bag member on the apparatus.

In the case of the latter toner cartridge disclosed in Unexamined Japanese Patent Publication No. Hei. 4-359274, the air permeable sheet member is provided on the toner discharge port so that the air permeating area is large. Accordingly, when it is not used for a long time, for example during storage, a blocking phenomenon where toner coheres together takes place. When the toner cartridge is set to the apparatus and toner is supplied, scattering of toner takes place.

SUMMARY OF THE INVENTION

The present invention has been made in order to solve the problems of the conventional art as mentioned above. An object of the present invention is to provide a toner cartridge which scatters little toner, is insensitive to variation of ambient conditions, and deteriorates the quality of toner very little even after storage for a long time. Another object of the present invention is to provide a toner cartridge which requires a decreased number of parts and can be manufactured efficiently.

A toner cartridge of the present invention includes: a container for containing toner; a toner discharge port formed on said container; a sealing member for sealing the toner discharge port; an air communicating portion which is provided on the container, having an air communicating hole an opening with an area which is smaller than that of the discharge port; and an air permeable member for covering the air hole, adjusting a pressure within the container, and restricting permeation of moisture into the container so as to prevent a blocking phenomenon of toner. The air permeable member may be fabricated from a porous material.

Specifically, a coefficient of moisture permeability of the porous material is 100 to 1000 g/m$^2$/24 hours in a measuring method of JIS (Japanese Industrial Standard) L-1096-A-11 to restrict permeation of moisture into the container so as to prevent a blocking phenomenon of toner.

In the toner cartridge of the present invention, the air hole which is covered with the porous material having the above-described moisture permeability, is provided separately from the toner discharge port, thereby securing the permeation of air. Accordingly, the increase of the inner pressure within the toner cartridge is held back, thereby preventing toner from scattering by the blow-out of toner when toner is supplied. Since the air filter of the porous material restricts the permeation of moisture, the toner storage stability is good. The toner will not change in quality after storage of toner for a long time. Therefore, toner will not cohere together, and the charge quantity of toner will not be reduced. To protect the sealing member at the toner discharge port, a shutter member may be used.

BRIEF DESCRIPTION OF THE DRAWINGS

In the accompanying drawings;

FIG. 1(*b*) is a cross sectional view of an cover portion of the conventional toner cartridge;

FIG. 2(*b*) is a cross sectional view showing a cap of the toner cartridge of the present invention.

DETAILED DESCRIPTION OF THE PREFERRED EMBODIMENT

Figure 1A:
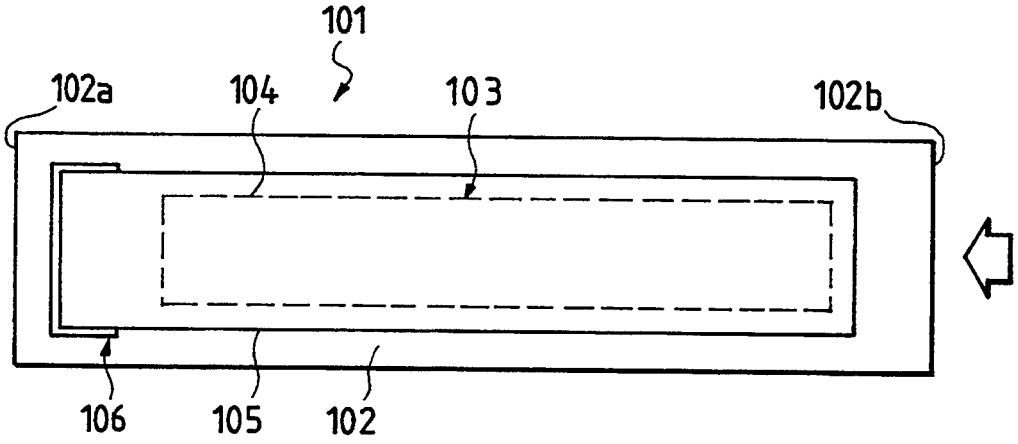
FIG. 1(a) PRIOR ART
FIG. 1(*a*) is a front view of a conventional toner cartridge.
Figure 1B:
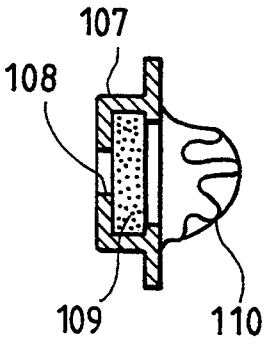
FIG. 1(b) PRIOR ART
Figure 2A:
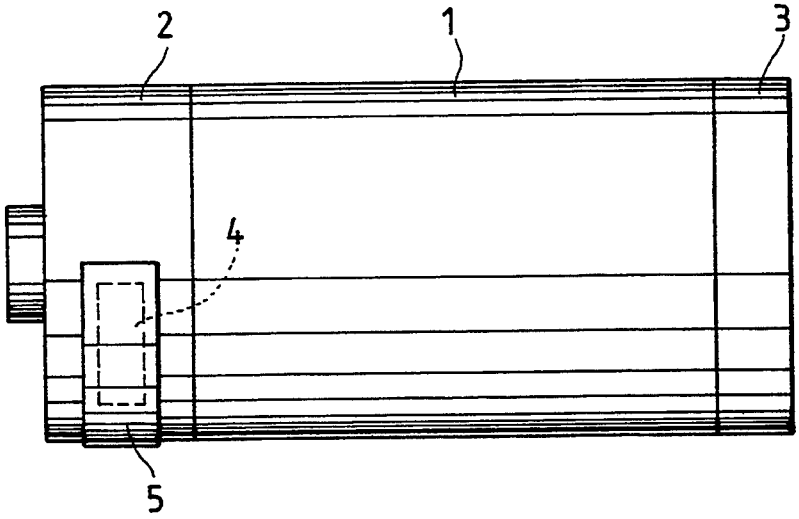
FIG. 2(*a*) is a side view showing an embodiment of a toner cartridge of the present invention.
Figure 2B:
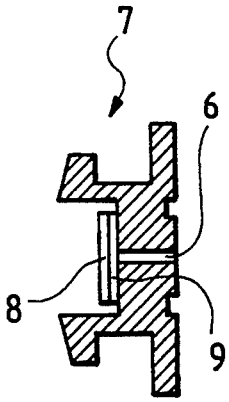
Figure 3:
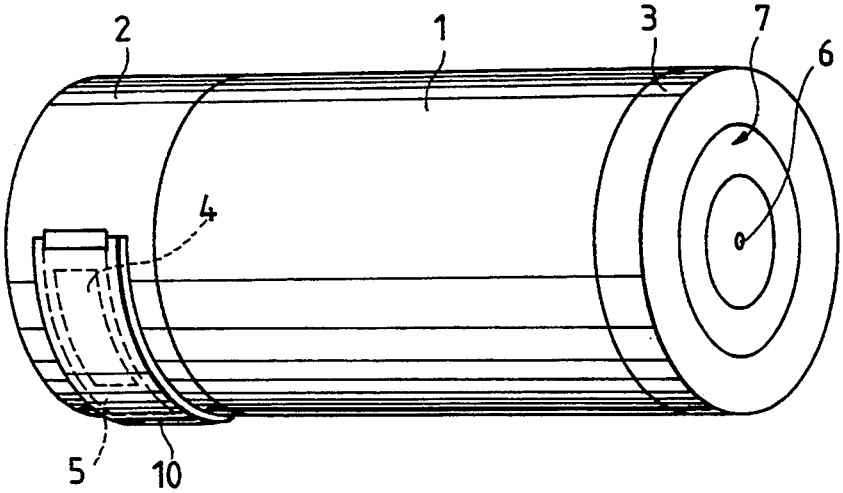
FIG. 3 is a perspective view showing another embodiment of a toner cartridge according to the present invention.

The embodiment of the present invention will be described with reference to the accompanying drawings. FIG. 2(*a*) is a side view showing a toner cartridge according to the present invention. FIG.2(*b*) is a cross sectional view showing a cap. FIG. 3 is a perspective view showing another embodiment of a toner cartridge of the present invention.

In the figures, the toner cartridge includes a main body 1 of a container, a discharge port section 2, and a filling port section 3. The discharge port section 2 has a discharge port 4 being sealed with a sealing member 5. As shown in FIG. 3, a shutter member 10 may be used in order to protect the sealing member at the discharge port 4. A cap 7 with an air hole 6 is mounted on the filling port section 3. A sheet-like air filter 8 made of porous material is bonded on the inner side of the cap 7 to close the air hole, by an adhesive tape 9.

In this embodiment, the air hole 6 may be formed at any location except the location of the toner discharge port 4, preferably formed in a holder member. The holder member is, for example, a cap. Where the air hole 6 is formed in the holder member, the porous material may be bonded to the holder member by an adhesive tape, a heat seal, or the like. Therefore, the porous material may be applied to the cartridge main body 1, which is made of any material.

An area of the air hole 6 is preferably within a range from 0.001 to 15 $cm^2$, more preferably 0.005 to 0.8 $cm^2$. When the area of the air hole 6 is smaller than 0.001 $cm^2$, the toner tends to coagulate. When the area of the air hole 6 is larger than 15 $cm^2$, toner tends to scatter when the toner is supplied. In this case, after the toner is stored for a long time, the toner changes in quality to cohere together.

The air hole 6 is covered with the porous material. The coefficient of moisture permeability of the porous material is in the range from 100 to 1000 $g/cm^2/24$ hr, measured by a measuring method of JIS L-1096-A-11. When the moisture permeability is larger than 1000 $g/m^2/24$ hr, moisture may enter allowing toner to cohere together and hence the toner storage stability is deteriorated. When the moisture permeability is smaller than 100 $g/m^2/24$ hr, sealing of the container is increased so that the container is easily burst. A preferable range of the moisture permeability is 500 to 700 $g/m^2/24$ hr. Within this range, the toner storage stability and the durability of the cartridge are excellent.

The porous material of moisture permeability may be any woven or unwoven fabric made of polyolefin resin, such as polyethylene and polypropylene, or other sheet-like materials. In the case of the sheet-like materials, the range of the moisture permeability thereof can be controlled when these are subjected to a surface treatment. In the case of the woven fabric, the range of the moisture permeability thereof can be controlled by changing densities of warp and weft by a flush weaving method.

When polyolefin resin is used for the porous material, the heat seal for polyethylene or the like is allowed, and hence use of the polyolefin resin is preferable. Accordingly, when a material allowing the heat sealing (e.g., polypropylene, polyethylene or the like) is used for the porous material, the cartridge main body 1 or the holder member can be covered through the heat sealing. The moisture permeability of the porous material is preferably within 10 to 200 $g/m^2/24$ hr. Further, the porous material has preferably a high strength so as to prevent the seal from being broken when the seal is peeled off.

More specific examples of the toner cartridge thus constructed will be described as follows.

EXAMPLE 1

An air hole (0.03 $cm^2$ in its area) was formed in the cap 7 shown in FIG. 2(*b*), the cap 7 was covered with an air filter A of porous material (processed polyethylene sheet) (its moisture permeability, measured by JIS L-1096-A-11: 650 $g/m^2/24$ hr), and the durability and the storage stability of the cartridge were empirically examined. The durability was satisfactory. For the storage stability, the cartridge was left as it is for 48 hours, and a state of toner cohesion was checked.

The results were as follows. Toner did not cohere together, and the toner cartridge was not broken. The cartridge was easily set to the machine. Toner was not scattered, and toner could be smoothly supplied.

COMPARATIVE EXAMPLE 1

A porous air filter A (processed polyethylene sheet) (moisture permeability thereof: 650 $g/m^2/24$ hr) was used as a peel-off film covering the toner discharge port (area thereof: 50 $cm^2$). The durability and the storage stability of the cartridge were empirically examined as in EXAMPLE 1.

The results were as follows. Toner cohered together to some extent under the condition of high temperature and humidity. The toner cartridge did not burst. When toner was supplied, toner was not scattered.

COMPARATIVE EXAMPLE 2

A porous air filter B (LUXER, manufactured by ASAHI KASEI Co., Ltd., moisture permeability: 5000 $g/m^2/24$ hr) was used. A toner cartridge was manufactured and evaluated as in Example 1. As a result of this example, toner absorbed moisture and cohered together.

COMPARATIVE EXAMPLE 3

A toner cartridge was manufactured using a porous air filter C (unwoven fabric made of polytetrafluoroethylene, moisture permeability: 5000 $g/m^2/24$ hr), and evaluated as in Example 1. As a result of this example, toner absorbed moisture and cohered together.

Physical properties of the porous air filters used in EXAMPLE 1 and COMPARATIVE EXAMPLES 1 to 3 were as tabulated below.

TABLE I

| | A | B | C |
|---|---|---|---|
| MOISTURE PERMEABILITY (JIS L1096) | 650(s/100 cc) | 5000(s/100 cc) | 5000(s/100 cc) |
| AIR PERMEABILITY (GAREY METHOD) | 30-60 ($g/m^2/24$ hrs) | 50 ($g/m^2/24$ hrs) | 100 ($g/m^2/24$ hrs) |

TABLE I-continued

| | A | B | C |
|---|---|---|---|
| TENSILE STRENGTH (HORIZONTAL/ VERTICAL) | 2.5/2.7(N/mm$^2$) {25/28(kg/cm$^2$)} | 2.5/2.7(N/mm$^2$) {20/21(kg/cm$^2$)} | 0.3/0.1(N/mm$^2$) {2.3/1.2(kg/cm$^2$)} |
| TEARING STRENGTH (HORIZONTAL/ VERTICAL) | 45.1 × 10$^{-3}$/ 45.1 × 10$^{-3}$(N/mm$^2$) {0.46/0.46(kg/cm$^2$)} | 83.3 × 10$^{-3}$/ 56.9 × 10$^{-3}$(N/mm$^2$) {0.85/0.58(kg/cm$^2$)} | 8.0 × 10$^{-3}$/ 27.4 × 10$^{-3}$(N/mm$^2$) {0.082/0.28(kg/cm$^2$)} |
| MATERIAL | POLYETHYLENE | POLYETHYLENE | POLYTETRAFLUORO-ETHYLENE |
| EFFECT | SMALL IN MOISTURE PERMEABILITY | LARGE IN MOISTURE PERMEABILITY | LARGE IN MOISTURE PERMEABILITY |
| HEAT SEALING FOR POLYETHYLENE | POSSIBLE | IMPOSSIBLE | IMPOSSIBLE |

EXAMPLE 2

A toner cartridge was manufactured using a porous air filter (unwoven fabric made of polyethylene, moisture permeability: 100 g/m$^2$/24 hr), and evaluated as in EXAMPLE 1.

As a result of this example, toner did not cohera together, the toner cartridge was not broken, and toner was not scattered.

Since the toner cartridge of the invention is constructed as described above, an increase of the inner pressure in the toner cartridge is held back, the discharge port is not damaged and toner scattering by the blow-out of toner can be prevented when toner is supplied. Further, the storage stability of toner is good, and toner is not changed in quality when it is stored for a long time. Thus, toner is prevented from cohering together and toner charge quantity is not reduced.

The toner cartridge of the invention requires a smaller number of parts than the conventional toner cartridge with the bag member, so that it can be manufactured more easily. Since the toner cartridge of the invention does not include the bag member, there is no need of the additional space for receiving the expanded bag. Accordingly, it can easily be set to a copying machine or a printer.

What is claimed is:

1. A toner cartridge comprising:

a container main body for containing toner;

a toner discharge port through which toner is discharged;

an air hole provided separate from the toner discharge port; and a porous material for covering said air hole;

wherein a coefficient of moisture permeability of said porous material is 100 to 1000 g/m$^2$/24 hours in a measuring method of JIS (Japanese Industrial Standard) L-1096-A-11.

2. A toner cartridge according to claim 1, wherein an area of said air hole is from 0.001 to 15 cm$^2$.

3. A toner cartridge according to claim 1, further comprising a holder member having said air hole.

4. A toner cartridge according to claim 1, wherein said porous material is made of polyolefin resin.

5. A toner cartridge comprising:

containing means for containing toner;

a toner discharge port formed on said containing means and having a first area;

sealing means for sealing said toner discharge port;

an air communicating portion provided on said containing means and having an air communicating hole, said air communicating hole having a second area smaller than said first area of said toner discharge port; and an air permeable member fabricated from a material that is substantially nonabsorbent to moisture for covering said air communicating hole, adjusting a pressure within said containing means, and restricting permeation of moisture into said containing means to prevent a blocking phenomenon of toner.

6. A toner cartridge according to claim 5, wherein said containing means includes a main body and a cap member fixed to said main body, and said air communicating portion is provided on said cap member.

7. A toner cartridge according to claim 5, wherein a coefficient of moisture permeability of said air permeable member is from 100 to 1000 g/m$^2$/24 hours in a measuring method of JIS (Japanese Industrial Standard) L-1096-A-11.

8. A toner cartridge according to claim 7, wherein the coefficient of moisture permeability of said air permeable member is from 500 to 700 g/m$^2$/24 hours in a measuring method of JIS (Japanese Industrial Standard) L-1096-A-11.

9. A toner cartridge according to claim 5, wherein said air permeable member is a polyethylene film.

10. A toner cartridge according to claim 5, further comprising shutter means for protecting said sealing means.

11. A toner cartridge according to claim 5, wherein said air permeable member is made of polyolefin resin.

12. A toner cartridge comprising:

containing means for containing toner;

a toner discharge port formed on said containing means and having a first area;

sealing means for sealing said toner discharge port;

an air communicating portion provided on said containing means and having an air communicating hole, said air communicating hole having a second area smaller than said first area of said toner discharge port, wherein said second area of said air communicating hole is from 0.001 to 15 cm$^2$; and an air permeable member for covering said air communicating hole, adjusting a pressure within said containing means, and restricting permeation of moisture into said containing means to prevent a blocking phenomenon of toner.

13. (Amended) A toner cartridge according to claim 12, wherein said second area of said air communicating hole is from 0.005 to 0.8 cm$^2$.

14. A toner cartridge according to claim 12, wherein said air permeable member is made of polyolefin resin.

* * * * *